US010989438B2

(12) United States Patent
Moro et al.

(10) Patent No.: US 10,989,438 B2
(45) Date of Patent: Apr. 27, 2021

(54) INDOOR UNIT FOR USE IN AIR-CONDITIONING APPARATUS AND AIR-CONDITIONING APPARATUS INCLUDING THE SAME

(71) Applicant: Mitsubishi Electric Corporation, Tokyo (JP)

(72) Inventors: Koki Moro, Tokyo (JP); Tetsuya Tazawa, Tokyo (JP); Keisuke Tomomura, Tokyo (JP); Hironobu Suehiro, Tokyo (JP); Takaaki Takishita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/471,286

(22) PCT Filed: Mar. 7, 2017

(86) PCT No.: PCT/JP2017/009005

§ 371 (c)(1),
(2) Date: Jun. 19, 2019

(87) PCT Pub. No.: WO2018/163285

PCT Pub. Date: Sep. 13, 2018

(65) Prior Publication Data

US 2019/0390871 A1 Dec. 26, 2019

(51) Int. Cl.
*F24F 13/08* (2006.01)
*F24F 13/20* (2006.01)
(Continued)

(52) U.S. Cl.
CPC ..... *F24F 13/084* (2013.01); *F24F 13/20* (2013.01); *F24F 13/32* (2013.01); *F24F 1/0047* (2019.02)

(58) Field of Classification Search
CPC ..... F24F 13/078; F24F 13/084; F24F 13/20; F24F 13/32; F24F 2221/14; F24F 1/0047
(Continued)

(56) References Cited

U.S. PATENT DOCUMENTS 3,335,535 A * 8/1967 Lane ..... E04B 1/34321 52/63
5,958,114 A * 9/1999 Sunahara ..... F24F 1/0007 96/417
(Continued)

FOREIGN PATENT DOCUMENTS

EP 1878976 A1 1/2008
JP H09-264563 A 10/1997
(Continued)

OTHER PUBLICATIONS

International Search Report of the International Searching Authority dated Jun. 6, 2017 for the corresponding International application No. PCT/JP2017/009005 (and English translation).
(Continued)

*Primary Examiner* — Vivek K Shirsat
(74) *Attorney, Agent, or Firm* — Posz Law Group, PLC

(57) ABSTRACT

An indoor unit of an air-conditioning apparatus includes: a main body provided with an opening port; and a rectangular decorative panel attached to the main body to cover the opening port. The decorative panel includes a rectangular suction grille provided to face the opening port of the main body. The suction grille has one side rotatably supported on one side of the decorative panel, and is detachably attached to the decorative panel. The one side of the suction grille and the one side of the decorative panel are secured to each other by a plurality of fall prevention strings. The decorative panel is provided with two panel claw portions to which the plurality of fall prevention strings are to be hooked. The suction grille is provided with two grille claw portions to each of which respective end portions of the plurality of fall prevention strings are to be hooked.

4 Claims, 6 Drawing Sheets

(51) Int. Cl.
*F24F 13/32* (2006.01)
*F24F 1/0047* (2019.01)

(58) Field of Classification Search
USPC ..... 454/275, 284, 292–304; 49/147
See application file for complete search history.

(56) References Cited

U.S. PATENT DOCUMENTS

| | | | | |
|---|---|---|---|---|
| 2009/0165432 | A1* | 7/2009 | Yabu ..... | F24F 13/28 55/415 |
| 2016/0135593 | A1* | 5/2016 | DeLorean ..... | E04B 9/003 52/1 |

FOREIGN PATENT DOCUMENTS

| | | | |
|---|---|---|---|
| JP | H11-241856 | A | 9/1999 |
| JP | 2000-161767 | A | 6/2000 |
| JP | 2001-108259 | A | 4/2001 |
| JP | 2012-145248 | A | 8/2012 |
| WO | 2009034937 | A1 | 3/2009 |

OTHER PUBLICATIONS

Examination Report dated Sep. 29, 2020 issued in corresponding IN patent application No. 201947034615.

* cited by examiner

INDOOR UNIT FOR USE IN AIR-CONDITIONING APPARATUS AND AIR-CONDITIONING APPARATUS INCLUDING THE SAME

CROSS REFERENCE TO RELATED APPLICATION

This application is a U.S. national stage application of PCT/JP2017/009005 filed on Mar. 7, 2017, the contents of which are incorporated herein by reference.

TECHNICAL FIELD

The present invention relates to an indoor unit for use in an air-conditioning apparatus and an air-conditioning apparatus including the indoor unit, and more particularly, to a decorative panel of the indoor unit that is provided with strings for preventing a suction grille from falling.

BACKGROUND ART

It is known that in an existing indoor unit of an air-conditioning apparatus, a suction grille is detachably attached to a decorative panel such that the suction grille can be opened and closed. Furthermore, in a proposed indoor unit, a decorative panel and a suction grille are connected to each other by a string to prevent the suction grille from falling when the suction grille is attached to or detached from the decorative panel (see Patent Literature 1).

CITATION LIST

Patent Literature

Patent Literature 1: Japanese Unexamined Patent Application Publication No. 2001-108259

SUMMARY OF INVENTION

Technical Problem

In an existing indoor unit, when a suction grille is detached from a decorative panel and fixed to the decorative panel by a string only, the string is pulled in a vertical direction by the weight of the suction grille. As a result, the suction grille may swing in a front-and-back direction and a left-and-right direction of the suction grille to come into contact with a worker or a wall.

The present invention has been made to solve the above problem, and an object of the invention is to provide an indoor unit for use in an air-conditioning apparatus and an air-conditioning apparatus including the indoor unit, which can dampen swings of a suction grille which occur in a front-and-back direction and a left-and-right direction of the suction grille when the suction grille is detached from a decorative panel and fixed to the decorative panel by strings only.

Solution to Problem

An indoor unit of an air-conditioning apparatus according to an embodiment of the present invention includes a main body provided with an opening port, and a rectangular decorative panel attached to the main body to cover the opening port. The decorative panel includes a rectangular suction grille provided to face the opening port of the main body. The suction grille has one side rotatably supported on one side of the decorative panel, and is detachably attached to the decorative panel. The one side of the suction grille and the one side of the decorative panel are secured to each other by a plurality of fall prevention strings each extending between the suction grille and the decorative panel. The decorative panel is provided with two panel claw portions to each of which respective portions of the plurality of fall prevention strings are to be hooked. The suction grille is provided with two grille claw portions to each of which respective end portions of the plurality of fall prevention strings are to be hooked. A distance W1 between the two panel claw portions is greater than a distance W2 between the two grille claw portions.

Advantageous Effects of Invention

An indoor unit of an air-conditioning apparatus according to an embodiment of the present invention is configured such that a distance W1 between panel claw portions for fixing fall prevention strings is greater than a distance W2 between grille claw portions for fixing the fall prevention strings. Thus, in the indoor unit, when a suction grille is fixed to a decorative panel by the fall prevention strings only, tensile forces exerted by the fall prevention strings act not only in a vertical direction but in a longitudinal direction of the suction grille. As a result, in the indoor unit, when the suction grille is fixed to the decorative panel by the strings only, swings of the suction grille which occur in a front-rear direction and a left-right direction of the suction grille can be reduced by the tensile forces by the fall prevention strings which act in the longitudinal direction of the suction grille.

An indoor unit for an air-conditioning apparatus and the air-conditioning apparatus according to an embodiment of the present invention will be described hereinafter with reference to the drawings. It should be noted that in each of the figures, components which are the same as or equivalent to those in a previous one of the figures are denoted by the same reference signs. The same is true of the entire text of the specification. Furthermore, the configurations of components described in the specification are merely examples, and are not limited to those in the specification. Furthermore, the relationship between sizes of components as illustrated in the figures may be different from that between actual sizes of the components. With respect to the embodiments, in order that they be easily understood, terms indicating directions (such as "upper", "lower", "right", "left", front", and "rear") are used as appropriate. However, these terms are used only for explanation, that is, they do not limit the embodiments.

EMBODIMENT 1

[Configuration of Indoor Unit]

Figure 1:
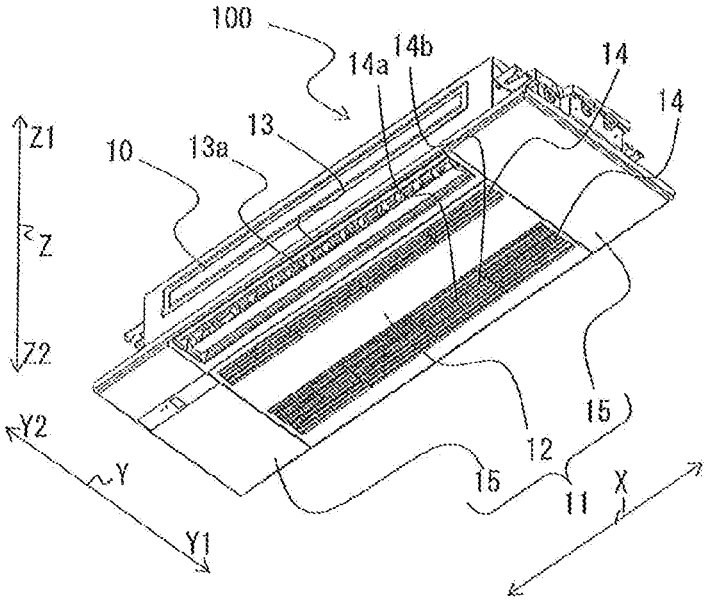
FIG. 1 is a perspective view illustrating an indoor unit of an air-conditioning apparatus according to embodiment 1 of the present invention.
Figure 2:
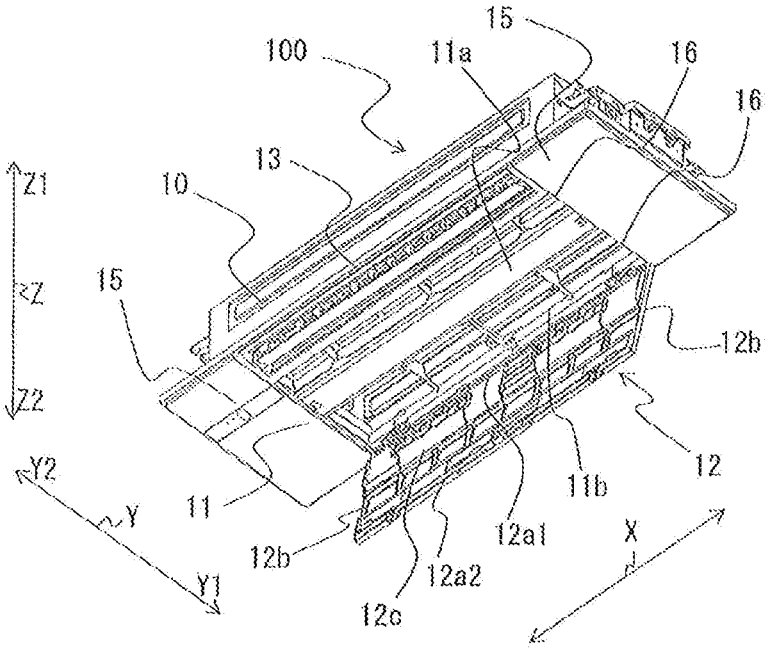
FIG. 2 is a perspective view illustrating the indoor unit of the air-conditioning apparatus according to embodiment 1 of the present invention in the case where a suction grille of the indoor unit is opened.

FIG. 1 is a perspective view illustrating an indoor unit of an air-conditioning apparatus according to embodiment 1 of the present invention. FIG. 2 is a perspective view illustrating the indoor unit for the air-conditioning apparatus according to embodiment 1 of the present invention in the case where a suction grille of the indoor unit is opened. In FIGS. 1 and 2, an X axis indicates the longitudinal direction of an indoor unit 100, a Y axis indicates the width direction of the indoor unit 100, and a Z axis indicates the height direction of the indoor unit 100. It should be noted that in the Z axis, an arrow Z1 indicates an upward direction or a ceiling side, and an arrow Z2 indicates a downward direction or an indoor side.

The indoor unit 100 includes a main body 10 in which an indoor heat exchanger (not illustrated) is housed and an opening portion 16 is provided at a lower surface of the main body 10 as illustrated in FIG. 2, and a rectangular decorative panel 11 attached to the main body 10 in such a way as to cover the opening portion 16 as illustrated in FIG. 1. The indoor unit 100 as illustrated in FIG. 1 is a ceiling suspended type indoor unit or a cassette type indoor unit in which the decorative panel 11 is exposed from a ceiling plate and the main body 10 is installed at an inner side of the ceiling plate, or a ceiling embedded type indoor unit, or a wall mounted type indoor unit.

[Decorative Panel]

The decorative panel 11 is made of a resin material, and is formed to have a rectangular shape as seen in plan view. It should be noted that the longitudinal direction (X-axis direction), the width direction (Y-axis direction) and the height direction (Z-axis direction) of the decorative panel 11 coincide with the longitudinal direction (X-axis direction), the width direction (Y-axis direction) and the height direction (Z-axis direction) of the indoor unit 100, respectively. The decorative panel 11 includes the rectangular suction grille 12 which is located to face the opening portion 16 of the main body 10. The suction grille 12 is located at a center position in the longitudinal direction (X-axis direction) of the decorative panel 11 as illustrated in FIG. 1. The decorative panel 11 includes side panels 15 which are provided on both sides of the suction grille 12 in the longitudinal direction (X-axis direction). Furthermore, in the decorative panel 11, an air outlet 13 is formed on one end side (Y2 side) of the decorative panel 11 in the width direction (Y-axis direction) thereof and extends along the longitudinal direction (X-axis direction) of the decorative panel 11 to allow air sent from the main body 10 to pass through the air outlet 13. It should be noted that the position of the air outlet 13 is not limited to the above one end side (Y2 side) of the decorative panel 11 in the width direction thereof, that is, it may be formed on the other end side (Y1 side) of the decorative panel 11 in the width direction. Also, the position of the air outlet 13 is not limited to any one of the end sides of the decorative panel 11 in the width direction thereof, and air outlets 13 may be formed on respective end sides (Y1 side and Y2 side) of the decorative panel 11 in the width direction. At the air outlet 13 of the decorative panel 11, an air-direction flap 13*a* is provided to change the flow direction of air sent from the main body 10. The decorative panel 11, as illustrated in FIG. 2 and as seen in plan view, includes a center frame portion 11*a* which is located at a center of the decorative panel 11 in the width direction and extends in the longitudinal direction, and an outer frame portion 11*b* which is provided to face the center frame portion 11*a* and extends in the longitudinal direction. The center frame portion 11*a* and the outer frame portion 11*b* are located between the main body 10 and the suction grille 12.

[Suction Grille]

The suction grille 12 has one side which is rotatably supported on one side of the decorative panel 11. The suction grille 12 is detachably attached to the decorative panel 11. The suction grille 12 is provided as part of a decorative surface of the decorative panel 11. The suction grille 12 includes a front long-side wall portion 12*a*1 and a rear long-side wall portion 12*a*2 which are located opposite to each other, and a plurality of short-side wall portions 12*b* which extend in a direction perpendicular to the front long-side side wall portion 12*a*1 and the rear long-side wall portion 12*a*2. The suction grille 12 further includes a bottom surface portion 12*c* surrounded by the front long-side side wall portion 12*a*1, the rear long-side wall portion 12*a*2 and the short-side wall portions 12*b*. In the suction grille 12, the rear long-side wall portion 12*a*2 is formed as a wall on the end side (Y2 side) on which the air outlet 13 is formed, and the front long-side side wall portion 12*a*1 is formed as a wall on the end side (Y1 side) opposite to the air outlet 13. The suction grille 12 is rectangular as seen in plan view, and the longitudinal direction of the suction grille 12 is the same direction as the longitudinal direction (X-axis direction) of the decorative panel 11. That is, the longitudinal direction (X-axis direction), the width direction (Y-axis direction) and the height direction (Z-axis direction) of the suction grille 12 coincide with the longitudinal direction (X-axis direction), the width direction (Y-axis direction) and the height direction (Z-axis direction) of the above-described indoor unit 100, respectively. It should be noted that each of the front long-side side wall portion 12*a*1 and the rear long-side wall portion 12*a*2 corresponds to "long-side side wall portion" of the present invention.

Air inlets 14 are formed in the bottom surface portion 12*c* of the suction grille 12 along the longitudinal direction (X-axis direction) as illustrated in FIG. 1. The air inlets 14 are through holes extending through the suction grille 12 toward the main body (Z1 side) and the indoor side (Z2 side). In the air inlet 14, a plurality of crosswise bars 14*a* and a plurality of longitudinal bars 14*b* are provided. The crosswise bars 14*a* are parallel to each other, and the longitudinal bars 14*b* are perpendicular to and connected to the crosswise bars 14*a*. Air in an indoor space is sucked into the main body 10 through the air inlet 14 formed in the suction grille 12.

[Fixing Between Decorative Panel and Suction Grille]

Figure 3:
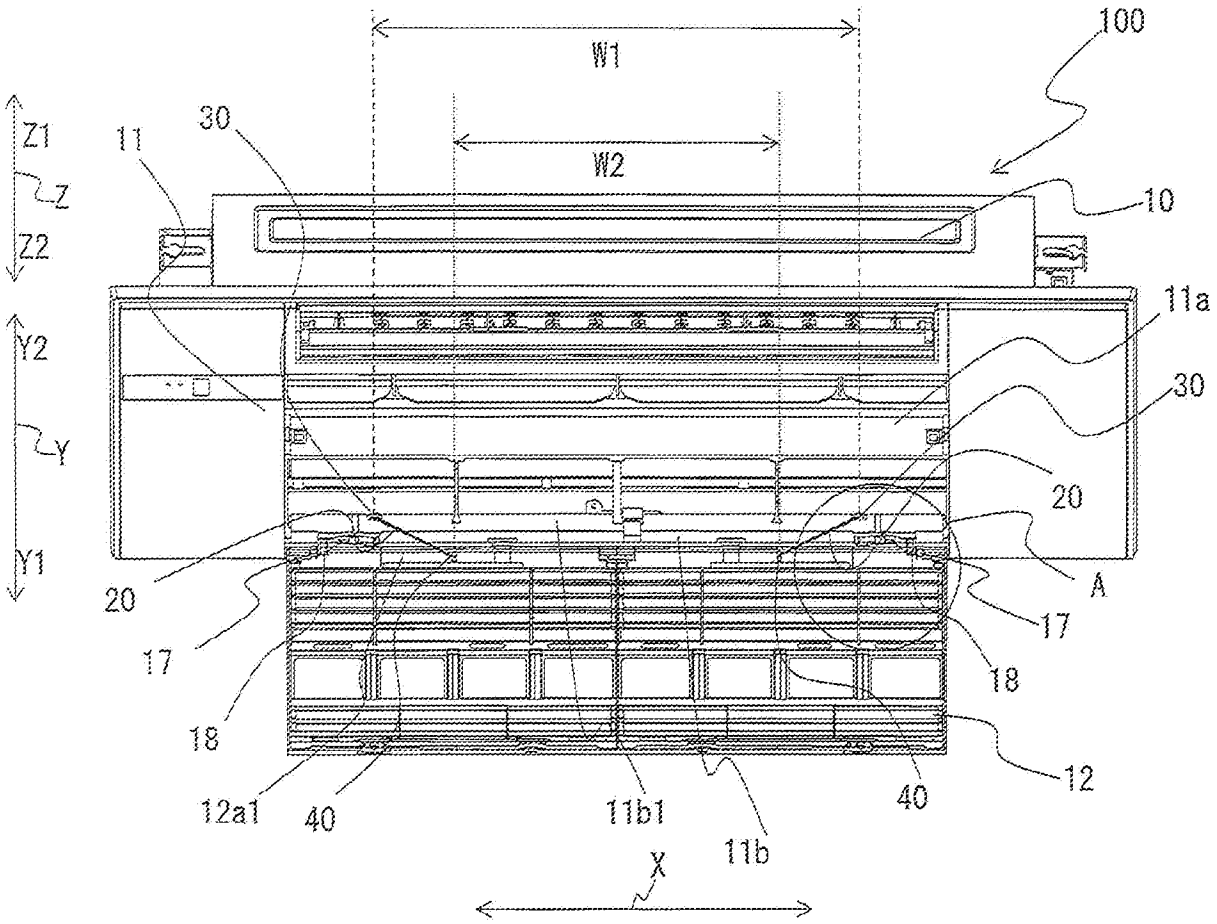
FIG. 3 is a front view illustrating the indoor unit of the air-conditioning apparatus according to embodiment 1 of the present invention in the case where the suction grille is opened from a decorative panel.
Figure 4:
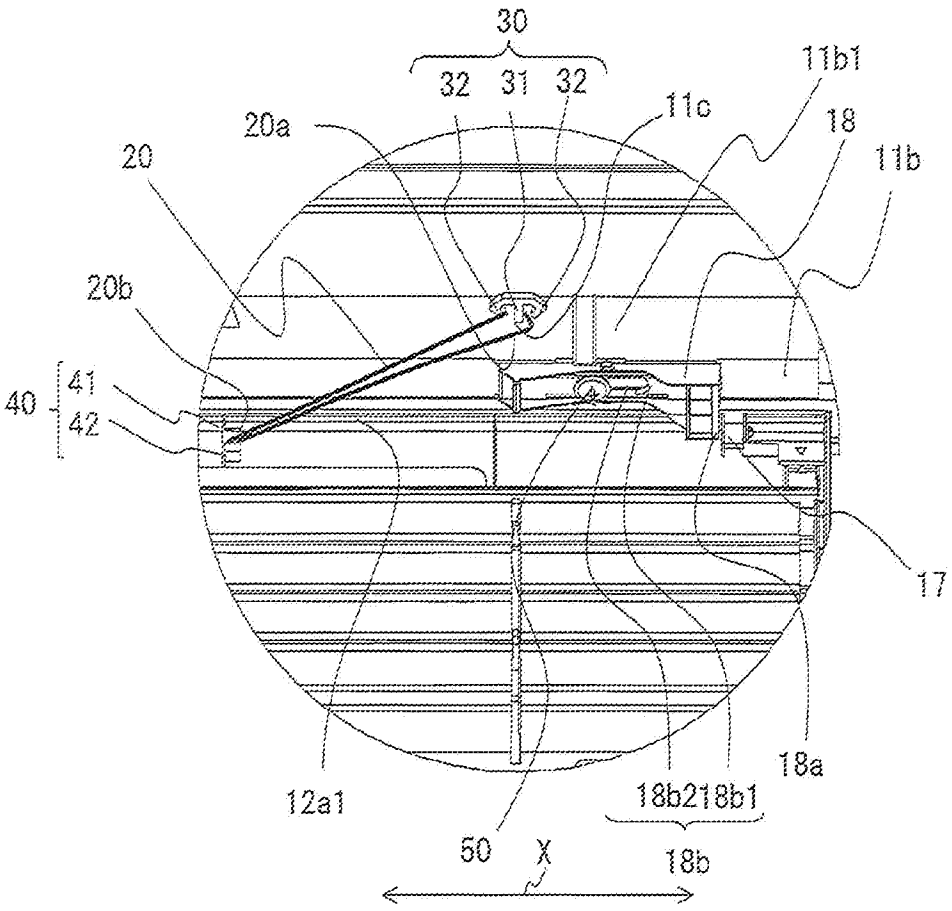
FIG. 4 is an enlarged view of part A of FIG. 3, which illustrates an engagement portion between the decorative panel and the suction grille of the indoor unit for the air-conditioning apparatus according to embodiment 1 of the present invention.

FIG. 3 is a front view illustrating the suction grille at the decorative panel of the indoor unit of the air-conditioning apparatus according to embodiment 1 of the present invention in the case where the suction grille is opened from the decorative panel. FIG. 4 is an enlarged view of part A indicated in FIG. 3, which illustrates an engagement portion between the decorative panel and the suction grille of the indoor unit of the air-conditioning apparatus according to embodiment 1 of the present invention.

The suction grille 12 includes cylindrical bearing portions 17 each of which is provided at the front long-side side wall portion 12*a*1 and includes a hollow portion extending in the longitudinal direction of the suction grille 12. The decorative panel 11 includes support shaft portions 18 each of which is provided at the frame portion 11*b*, has an axis extending parallel to the longitudinal direction of the decorative panel 11, and is slid in in the longitudinal direction of the decorative panel 11. Each support shaft portion 18 includes a shaft 18*a* extending parallel to the longitudinal direction of the decorative panel 11, and a slide portion 18*b* having an ellipse opening port 18*b*2 formed in a bottom wall portion 18*b*1 contacting the outer frame portion 11*b*. The support shaft portion 18 is fixed to the outer frame portion 11*b* by a screw 50 inserted in the opening port 18*b*2. When the screw 50 is loosened, the support shaft portion 18 can be moved in the longitudinal direction (X-axis direction) of the decorative panel 11 while being in contact with the screw 50 inserted in the opening port 18*b*2.

When the shaft 18*a* of the support shaft portion 18 is inserted into the hollow portion of the bearing portion 17, the support shaft portion 18 and the bearing portion 17 are engaged with each other, thereby fixing the suction grille 12 to the decorative panel 11. Because of the engagement of the support shaft portion 18 and the bearing portions 17, the shaft 18*a* of the support shaft portion 18 serves as a rotation shaft around which the suction grille 12 is opened and closed. The one side of the suction grille 12 that extends in the longitudinal direction thereof is rotatably supported on the one side of the decorative panel 11. The suction grille 12 is rotated to cover or expose the opening portion 16. To be more specific, when rotated, the suction grille 12 is opened to allow an air filter set in the suction grille 12 to be replaced by a new air filter, and also allow the inside of the main body 10 to be cleaned, and then when rotated, the suction grille 12 is closed. It should be noted that fixing of the suction grille 12 to the decorative panel 11 is not limited to engagement of the bearing portions 17 with the support shaft portion 18, and another fixing method may be applied as long as it is a method for causing the suction grille 12 to be rotatably supported on the decorative panel 11. For example, in the case of fixing the suction grille 12 and the decorative panel 11 to each other, the shaft of the suction grille 12 that extends in the longitudinal direction may be hung on a hook-shaped attachment portion provided in the decorative panel 11, whereby the suction grille 12 is rotatably supported on the decorative panel 11.

The suction grille 12 can be detached from the decorative panel 11, by moving the support shaft portion 18 in the longitudinal direction (X-axis direction) of the decorative panel 11 while being in contact with the screw 50 inserted in the opening port 18*b*2 to remove the shaft 18*a* of the support shaft portion 18 from the bearing portions 17. That is, the suction grille 12 can be attached to and detached from the decorative panel 11 by moving the support shaft portion 18 in the longitudinal direction (X-axis direction).

[Fall Prevention String]

The indoor unit 100 includes strings 20 for preventing the suction grille 12 from falling when the support shaft portion 18 is removed from the bearing portions 17. The one side of the suction grille 12 is rotatably supported on the one side of the decorative panel 11, and is detachably attached to the decorative panel 11. Also, the one side of the suction grille 12 is connected to the one side of the decorative panel 11 by a plurality of fall prevention strings 20 extending between the suction grille 12 and the decorative panel 11.

As illustrated in FIGS. 3 and 4, the decorative panel 11 is provided with two panel claw portions 30 each of which is provided to hold a bent portion 20*a* of an associated one of the fall prevention strings 20 extending between the suction grille 12 and the decorative panel 11. Each of the panel claw portions 30 is formed in such a way as to protrude from an inner wall portion 11*b*1 forming a surface of the outer frame portion 11*b* that faces the center frame portion 11*a*. The two panel claw portions 30 are arranged in the longitudinal direction of the decorative panel 11. As illustrated in FIG. 4, each of the panel claw portions 30 includes: a pillar portion 31 having ends one of which is connected to the inner wall portion 11*b*1 and the other of which is bifurcated into two end portions; and curved portions 32 which are curved from the end portions toward a connection portion 11*c* between the inner wall portion 11*b*1 and the pillar portion 31, and form distal end portions of the panel claw portion 30. Because of the presence of the pillar portion 31 and the curved portions 32, the string can be easily hooked to the panel claw portion 30, and the hooked string does not easily fall off of the panel claw portion 30.

As illustrated in FIGS. 3 and 4, the suction grille 12 is provided with two grille claw portions 40 each of which is provided to hold end portions 20*b* of an associated one of the fall prevention strings 20 extending between the suction grille 12 and the decorative panel 11. The two grille claw portions 40 are arranged in the longitudinal direction of the suction grille 12. Each of the grille claw portions 40 includes an intermediate wall portion 41 having a plate-like shape and protruding from the front long-side side wall portion 12*a*1 in the width direction of the suction grille 12, and a protrusion portion 42 having a semi-annular shape and having ends connected to the intermediate wall portion 41. The protrusion portions 42 of the two grille claw portions 40 are formed to protrude in opposite directions from surfaces of the intermediate wall portions 41 of the two grille claw portions 40, which are located on opposite sides of those sides of the intermediate wall portions 41 which face each other.

As illustrated in FIG. 4, the fall prevention string 20 is bent at the bent portion 20*a*, and the bent portion 20*a* is hooked to the panel claw portion 30 of the decorative panel 11, and the end portions 20*b* of the fall prevention string 20 are tied around and hooked to the grille claw portion 40 of the suction grille 12. However, this is not limitative. That is, any method may be used as long as the panel claw portion 30 and the grip claw portion 40 are reliably secured to each other using the fall prevention string 20. For example, the following method may be applied: the end portions 20*b* of the fall prevention string 20 are tied around and hooked to the grille claw portion 40, and an annular connection tool is attached to the portion 20*a* of the fall prevention string 20 and is then hooked to the panel claw portion 30.

The distance W1 between the two panel claw portions 30 is greater than the distance W2 between the two grille claw portions 40. Thus, the two strings 20 connecting the decorative panel 11 and the suction grille 12 are not parallel to each other in a vertical direction (Z-axis direction). To be more specific, the two strings 20 obliquely extend such that the distance between portions of the fall prevention strings 20 which are connected to the decorative panel 11 is greater than the distance between portions of the fall prevention strings 20 that are connected to the suction grille 12. As a result, as tension in the two strings 20, tension forces exerted by the two strings 20 act not only in the vertical direction (Z-axis direction) but in the longitudinal direction (X-axis direction) of the suction grille 12.

Figure 5:
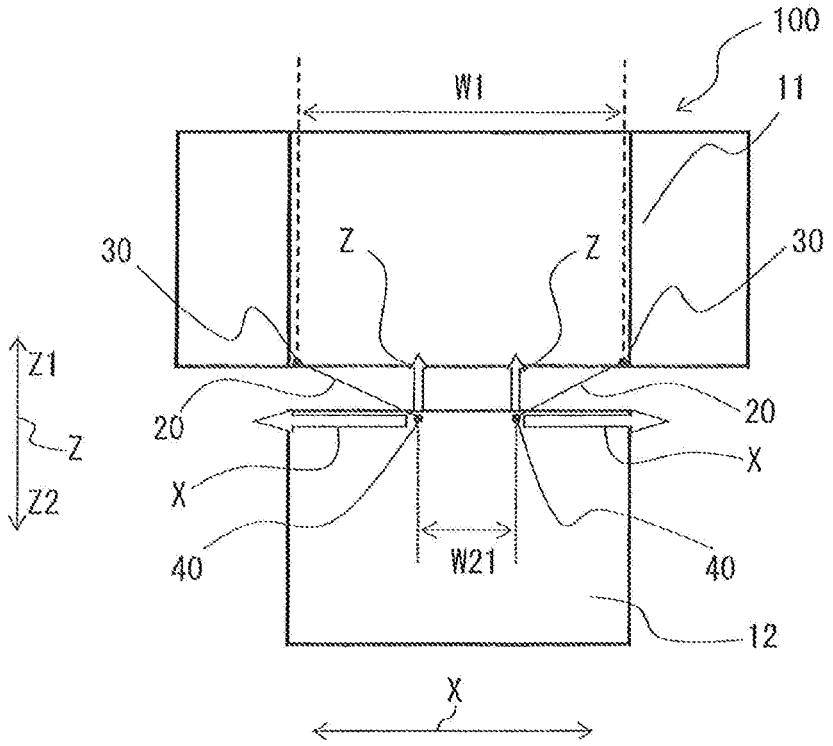
FIG. 5 is a simplified diagram indicating fixing positions of strings between the decorative panel and the suction grille of the indoor unit of the air-conditioning apparatus according to embodiment 1 of the present invention.
Figure 6:
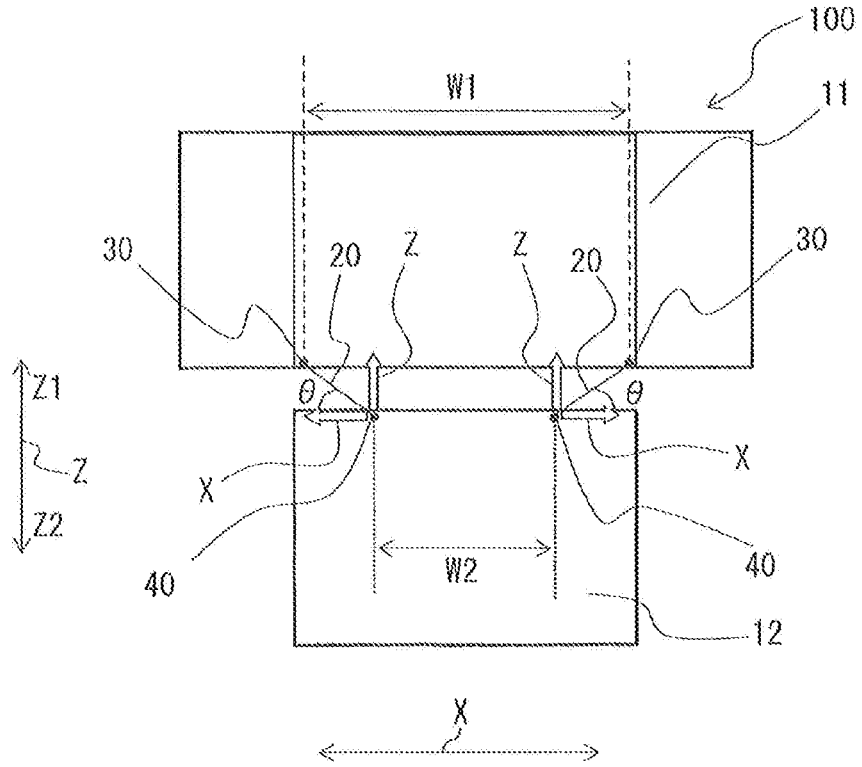
FIG. 6 is a simplified diagram illustrating another example of the fixing positions of the strings between the decorative panel and the suction grille of the indoor unit of the air-conditioning apparatus according to embodiment 1 of the present invention.

FIG. 5 is a simplified diagram indicating fixing positions of the strings between the decorative panel and the suction grille of the indoor unit of the air-conditioning apparatus according to embodiment 1 of the present invention. FIG. 6 is a simplified diagram indicating another example of the fixing positions of the strings between the decorative panel and the suction grille of the indoor unit of the air-conditioning apparatus according to embodiment 1 of the present invention. The indoor unit as illustrated in FIG. 5 is different from the indoor unit in FIG. 6 in the positions of the grille claw portions 40. In both the indoor unit 100 as illustrated in FIG. 5 and the indoor unit 100 in FIG. 6, the distance W1 between the panel claw portions 30 is greater than the distance W21 between the grille claw portions 40. However, the grille claw portions 40 at the suction grille 12 of the indoor unit 100 as illustrated in FIG. 5 are arranged closer to the center of the suction grille 12 than those of the indoor unit 100 as illustrated in FIG. 6.

In the indoor unit 100 as illustrated in FIG. 5, tension forces X by the fall prevention strings 20 which act in the longitudinal direction (X-axis direction) of the suction grille 12 are stronger than tension forces Z by the fall prevention strings 20 which act in the vertical direction (Z-axis direction). Thus, the suction grille 12 of the indoor unit 100 as illustrated in FIG. 5 more easily swings in the longitudinal direction (X-axis direction) than that of the indoor unit 100 as illustrated in FIG. 6. In the indoor unit 100 as illustrated in FIG. 6, the tension forces X by the strings which act in the longitudinal direction of the suction grille 12 are substantially equivalent to the tension forces Z by the strings which act in the vertical direction. In the indoor unit 100 as illustrated in FIG. 6, in the case of arranging the panel claw portions 30 and the grille claw portions 40, the distance W1 between the two panel claw portions 30 and the distance W2 between the two grille claw portions 40 are determined such that the tension forces X are equivalent to the tension forces Z, and thus the panel claw portions 30 are separated from each other by the determined distance W1 and the grille claw portions 40 are separated from each other by the determined distance W2. Alternatively, each of the fall prevention strings 20 is extended and inclined at an angle of 45 degrees with respect to the longitudinal direction of the suction grille 12. That is, as illustrated in FIG. 6, an angle θ between the suction grille 12 and each string 20 is 45 degrees. Therefore, in the indoor unit 100 as illustrated in FIG. 6, the tension forces X by the fall prevention strings 20 which act in the longitudinal direction (X-axis direction) of the suction grille 12 are substantially equivalent to the tension forces Z by the strings which act in the vertical direction (Z-axis direction). Thus, the stability of the suction grille 12 held by the fall prevention strings 20 is improved.

Next, it will be described how the suction grille 12 is attached to the decorative panel 11. In the attachment of the suction grille 12 to the decorative panel 11, first, the panel claw portions 30 of the decorative panel 11 are secured to the respective grille claw portions 40 of the suction grille 12 using the respective fall prevention strings 20. Then, the shafts 18*a* are inserted into the hollow portions of the respective bearing portions 17 to attach the support shaft portions 18 of the decorative panel 11 to the bearing portions 17 of the suction grille 12. At this time, since the suction grille 12 is temporarily fixed by the fall prevention strings 20, the support shaft portions 18 need not to be aligned with the bearing portions 17, and attachment of the suction grille 12 is easily achieved. Next, the suction grille 12 is rotated around the support shaft portion 18, and is fitted in the decorative panel 11, and the suction grille 12 is fixed to the decorative panel 11 on the opposite side of the side on which the support shaft portion 18 is located. It should be noted that in the case of detaching the suction grille 12 from the decorative panel 11, it is detached in reverse order of the above.

Figure 7:
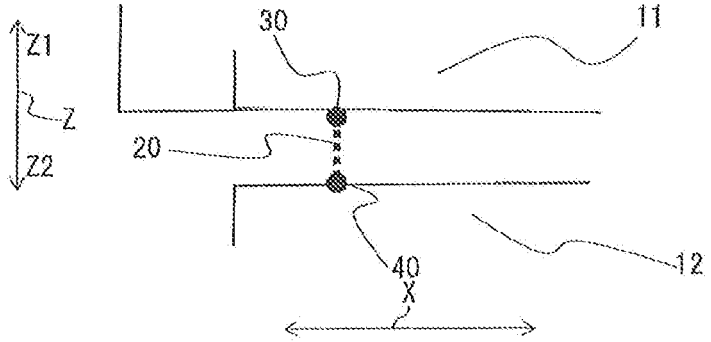
FIG. 7 is a simplified partial enlarged view illustrating part of the suction grille of the indoor unit in the case where the distance W1 and the distance W2 are nearly equal to each other and the suction grille is opened.
Figure 8:
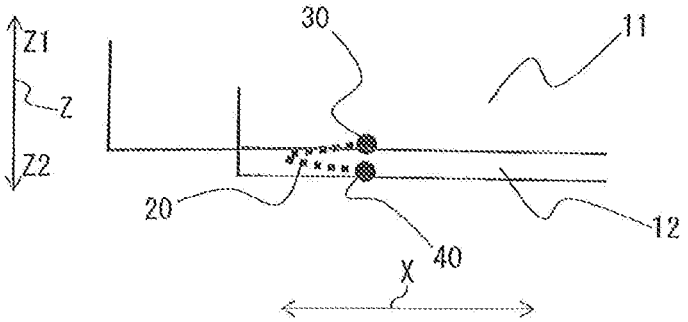
FIG. 8 is a simplified partial enlarged view illustrating the suction grille of the indoor unit in the case where the distance W1 and the distance W2 are nearly equal to each other and the suction grille is closed.

FIG. 7 is a simplified partial enlarged view illustrating part of the suction grille of the indoor unit in the case where the distance W1 and the distance W2 are nearly equal to each other and the suction grille is opened. FIG. 8 is a simplified partial enlarged view illustrating the suction grille of the indoor unit in the case where the distance W1 and the distance W2 are nearly equal to each other and the suction grille is closed. In the case where the panel claw portions 30 and the grille claw portions 40 are arranged such that the distance W1 and the distance W2 are nearly equal to each other, the fall prevention strings 20 are pulled in the vertical direction (Z-axis direction). In this case, as illustrated in FIG. 8, when the suction grille 12 is closed, the fall prevention strings 20 may be greatly bent and thus caught between the decorative panel 11 and the suction grille 12.

Figure 9:
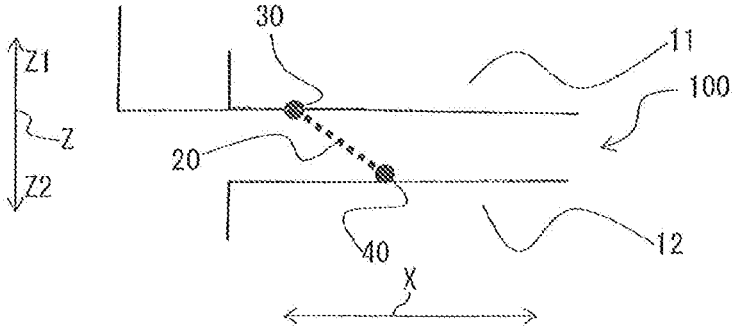
FIG. 9 is a simplified partial enlarged view illustrating the suction grille of the indoor unit for the air-conditioning apparatus according to embodiment 1 of the present invention in the case where the suction grille is opened.
Figure 10:
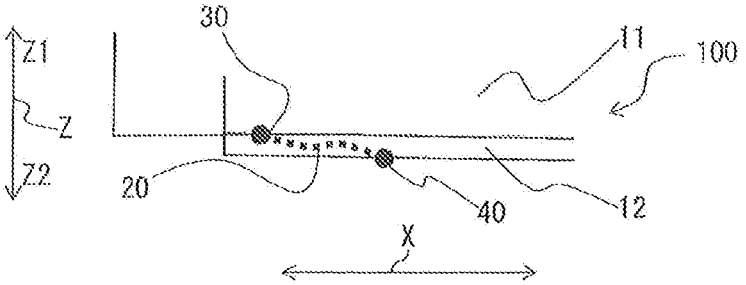
FIG. 10 is a simplified partial enlarged view illustrating the suction grille of the indoor unit for the air-conditioning apparatus according to embodiment 1 of the present invention in the case where the suction grille is closed.

FIG. 9 is a simplified partial enlarged view illustrating the suction grille of the indoor unit of the air-conditioning apparatus according to embodiment 1 of the present invention in the case where the suction grille is opened. FIG. 10 is a simplified partial enlarged view illustrating the suction grille of the indoor unit of the air-conditioning apparatus according to embodiment 1 of the present invention in the case where the suction grille is closed. In the case where the panel claw portions 30 and the grille claw portions 40 are arranged such that the distance W1 is greater than the distance W2 as in the indoor unit 100 of the air-conditioning apparatus according to embodiment 1 of the present invention, the fall prevention strings 20 are pulled in the vertical direction (Z-axis direction) and the longitudinal direction (X-axis direction) of the suction grille 12. In this case, as illustrated in FIG. 8, when the suction grille 12 is closed, the fall prevention strings 20 are not greatly bent, that is, they are slightly bent. Therefore, the fall prevention strings 20 can be attached to the decorative panel 11 without being caught between the decorative panel 11 and the suction grille 12.

As described above, in the indoor unit 100, the distance W1 between the panel claw portions 30 is greater than the distance W2 between the grille claw portions 40. Therefore, in the indoor unit 100, when the suction grille 12 is fixed to the decorative panel 11 by the fall prevention strings 20 only, tension forces exerted by the fall prevention strings 20 act not only in the vertical direction but in the longitudinal direction of the suction grille 12. As a result, in the indoor unit 100, when the suction grille 12 is fixed to the decorative panel 11 by the fall prevention strings 20 only, the tension forces by the fall prevention strings 20 which act in the longitudinal direction of the suction grille 12 can dampen swings of the suction grille 12 which occur in the front-and-back direction and the left-and-right direction. Therefore, when fixed to the decorative panel 11 by the fall prevention strings 20 only, the suction grille 12 can be prevented from coming into contact with a worker or the wall. It is therefore possible to improve the workability and the safety of the worker in attachment and detachment of the suction grille.

Also, in the indoor unit 100, the strings can reliably dampen swings of the suction grille which occur in the left-and-right direction when the suction grille is fixed to the decorative panel by the strings only, as compared with an indoor unit in which the distance between the two panel claw portions (fixing positions of the strings) provided in the decorative panel and the distance between the two grille claw portions (fixing position of the strings) provided in the suction grille are nearly equal to each other. This is because in the indoor unit in which the distance between the fixing positions of the two strings provided in the decorative panel and the distance between the fixing positions of the two strings provided in the suction grille are nearly equal to each other, the two strings fixing the suction grille to the decorative panel are pulled parallel to each other in the vertical direction when the suction grille is fixed to the decorative panel by the strings only. Therefore, in such an indoor unit, tension forces exerted by the strings act in the vertical direction only, that is, they do not act to dampen swings of the suction grille which occur in the left-and-right direction. As a result, in such an indoor unit, the suction grille easily swings in the left-and-right direction when the suction grille is fixed to the decorative panel by the strings only.

On the other hand, in the indoor unit 100, the distance W1 between the panel claw portions 30 is greater than the distance W2 between the grille claw portions 40. Therefore, in the indoor unit 100, when the suction grille 12 is fixed to the decorative panel 11 by the fall prevention strings 20 only, tension forces exerted by the fall prevention strings 20 act not only in the vertical direction but in the longitudinal direction of the suction grille 12. As a result, in the indoor unit 100, when the suction grille 12 is fixed to the decorative panel 11 by only, the tension forces exerted by the fall prevention strings 20 which act in the longitudinal direction of the suction grille 12 can dampen swings of the suction grille 12 which occur in the left-and-right direction. Therefore, when the suction grille 12 is fixed to the decorative panel 11 by the fall prevention strings 20 only, the suction grille can be prevented from coming into contact with a worker or the wall, thereby improving the workability and the safety of the worker in attachment and detachment of the suction grille.

In the indoor unit 100, in arrangement of the panel claw portions 30 and the grille claw portions 40, the distance W1 between the panel claw portions 30 and the distance W2 between the grille claw portions 40 are determined such that the tension forces X by the fall prevention strings 20 which act in the longitudinal direction (X-axis direction) of the suction grille 12 are equivalent to the tension forces Z by the fall prevention strings 20 which act in the vertical direction (Z-axis direction); that is, the panel claw portions 30 are separated from each other by the determined distance W1, and the grille claw portions 40 are separated from each other by the determined distance W2. Thus, in the indoor unit 100, the tension forces X by the fall prevention strings 20 which act in the longitudinal direction (X-axis direction) of the suction grille 12 are substantially equivalent to the tension forces Z by the fall prevention strings 20 which act in the vertical direction (Z-axis direction) of the fall prevention string 20. Therefore, in the indoor unit 100, the stability of the suction grille 12 in the case where the suction grille 12 is fixed to the decorative panel 11 by the fall prevention strings 20 only is improved.

Furthermore, in the indoor unit 100, the fall prevention strings 20 are provided to extend at an angle of 45 degrees with respect to the longitudinal direction of the suction grille 12. Therefore, in the indoor unit 100, the tension forces X by the fall prevention strings 20 which act in the longitudinal direction (X-axis direction) of the suction grille 12 are substantially equivalent to the tension forces Z by the fall prevention string 20 which act in the vertical direction (Z-axis direction). As a result, in the indoor unit 100, the stability of the suction grille 12 in the case where suction grille 12 is fixed to the decorative panel 11 by the fall prevention strings 20 only is improved.

Furthermore, the indoor unit 100 is configured such that the distance W1 between the panel claw portions 30 is greater than the distance W2 between the grille claw portions 40. Therefore, the suction grille 12 can be temporarily fixed by the fall prevention strings 20, and can thus be easily positioned, thereby improving the workability in attachment of the suction grille 12.

In addition, the indoor unit 100 is configured such that the distance W1 between the panel claw portions 30 is greater than the distance W2 between the grille claw portions 40. Thus, the fall prevention strings 20 are not greatly bent when the suction grille 12 is closed to fit in to the decorative panel 11. Thus, it is possible to omit the work of setting the strings such that the strings will not be caught between the suction grille 12 and the decorative panel 11 when the suction grille 12 is closed, thereby improving the workability in attachment of the suction grille 12.

In the indoor unit 100, each of the grille claw portions 40 includes the intermediate wall portion 41 which is formed in the shape of a plate and to protrude from the front long-side side wall portion 12*a*1 in the width direction of the suction grille 12, and the protrusion portion 42 having a semi-annular shape and having ends connected to the intermediate wall portion 41. The protrusion portions 42 of the two grille claw portions 40 protrude in opposite directions from respective surfaces of the intermediate wall portions 41 of the two grille claw portions 40, which are located on opposite sides of sides of the intermediate wall portions 41 which face each other. Therefore, each of the protrusion portions 42 protrudes in a direction in which each protrusion portion 20 is pulled by an associated one of the fall prevention strings 20, and is configured to receive from a substantially front side of the protrusion portion 42, a force with which the protrusion portion 20 is pulled by the fall prevention string 20 when the suction grille 12 is fixed to the decorative panel 11 by the fall prevention strings 20 only. Therefore, the tension force exerted by the fall prevention string 20 acts on the protrusion portion 42 in a balanced manner, and the durability of the grille claw portion 40 can thus be maintained.

In the indoor unit 100, each of the panel claw portions 30 includes: the pillar portion 31 having ends one of which is connected to the inner wall portion 11*b*1 and the other of which is bifurcated into two end portions; and the curved portions 32 that are curved from the end portions toward the connection portion 11*c* between the inner wall portion 11*b*1 and the pillar portion 31, and form distal end portions of the panel claw portion 30. In such a manner, since the panel claw portion 30 includes the pillar portion 31 and the curved portions 32, the fall prevention string 20 can be easily hooked to the panel claw portion 30, and does not easily fall off of the panel claw portion 30.

Figure 11:
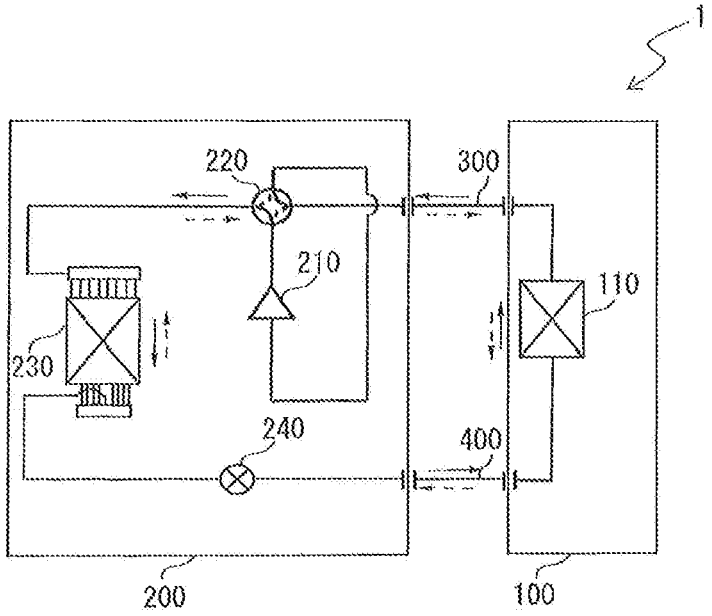
FIG. 11 is a diagram illustrating a configuration example of the air-conditioning apparatus according to embodiment 1 of the present invention.

FIG. 11 is a diagram illustrating a configuration example of the air-conditioning apparatus according to embodiment 1 of the present invention. Also, FIG. 11 illustrates an air-conditioning apparatus 1 as an example of a refrigeration cycle apparatus. In FIG. 11, solid arrows indicate the flow of refrigerant in the cooling operation, and dashed arrows indicate the flow of refrigerant in the heating operation. The air-conditioning apparatus 1 as illustrated in FIG. 11 includes an outdoor unit 200 and the indoor unit 100, and the outdoor unit 200 and the indoor unit 100 are connected to each other by a gas refrigerant pipe 300 and a liquid refrigerant pipe 400.

The outdoor unit 200 includes a compressor 210, a flow-path switching device 220, an outdoor heat exchanger 230 and an expansion valve 240. The compressor 210 compresses sucked refrigerant, and discharges the refrigerant. It should be noted that the compressor 210 may be configured such that it is controlled by, for example, an inverter circuit, and its operating frequency is arbitrarily changed, whereby a capacity (the amount of refrigerant sent per unit time) of the compressor 210 can be changed. The flow-path switching device 220 is, for example, a four-way valve, and changes the direction of the flow path of the refrigerant in a switching manner. The outdoor heat exchanger 230 causes heat exchange to be performed between the refrigerant and air (outdoor air). In the heating operation, the outdoor heat exchanger 230 operates as an evaporator, and evaporates and gasifies the refrigerant. In the cooling operation, the outdoor heat exchanger 230 operates as a condenser, and condenses and liquefies the refrigerant. The expansion valve 240 is an expansion device (a flow-rate control unit), operates as an expansion valve which regulates the flow rate of refrigerant flowing through the expansion valve 240, and reduces the pressure of the refrigerant having flowed into the expansion valve 240. For example, in the case where the expansion valve 240 is an electronic expansion valve, its opening degree is adjusted in response to an instruction given by, for example, a controller (not illustrated).

The indoor unit 100 includes an indoor heat exchanger 110. The indoor heat exchanger 110 causes heat exchange to be performed between air to be air-conditioned and refrigerant. In the heating operation, the indoor heat exchanger 110 operates as a condenser, and condenses and liquefies the refrigerant. In the cooling operation, the indoor heat exchanger 110 operates as an evaporator, and evaporates and gasifies the refrigerant.

As described above, the air-conditioning apparatus 1 can perform the heating operation and the cooling operation by changing the flow of the refrigerant using the flow-path switching device 220 of the outdoor unit 200 in the switching manner.

It should be noted that the embodiment of the present invention is not limited to embodiment 1 described above, and can be variously modified. For example, with respect to the configuration of the grille claw portions 40, it suffices that the grille claw portions 40 are formed capable of fixing the end portions 20*b* of the fall prevention strings 20, and semi-annular protrusion portions may be provided as the grille claw portions 40 at the bottom surface portion 12*c* of the suction grille 12. Similarly, with respect to the configuration of the panel claw portions 30, it suffices that the panel claw portions 30 are formed capable of fixing the bent portions 20*a* of the fall prevention strings 20, and semi-annular protrusion portions may be provided as the panel claw portions 30 on the inner wall portion 11*b*1.

REFERENCE SIGNS LIST

1 air-conditioning apparatus 10 main body 11 decorative panel 11*a* center frame portion 11*b* outer frame portion 11*b*1 inner wall portion 11*c* connection portion 12 suction grille 12*a*1 front long-side side wall portion 12*a*2 rear long-side wall portion 12*b* short-side wall portion 12*c* bottom surface portion 13 air outlet 13*a* airflow direction flap 14 air inlet 14*a* crosswise bar 14*b* longitudinal bar 15 side panel 16 opening portion 17 bearing portion 18 support shaft portion 18*a* shaft 18*b* slide portion 18*b*1 bottom wall portion 18*b*2 opening port 20 string 20*a* bent portion 20*b* end portion 30 panel claw portion 31 pillar portion 32 curved portion 40 grille claw portion 41 intermediate wall portion 42 protrusion portion 50 screw 100 indoor unit 110 indoor heat exchanger 200 outdoor unit 210 compressor 220 flow-path switching device 230 outdoor heat exchanger 240 expansion valve 300 gas refrigerant pipe 400 liquid refrigerant pipe

The invention claimed is:

1. An indoor unit of an air-conditioning apparatus, comprising:

a main body provided with an opening port; and a rectangular decorative panel attached to the main body to cover the opening port, the decorative panel including a rectangular suction grille provided to face the opening port of the main body, the suction grille having one side rotatably supported on one side of the decorative panel, and being detachably attached to the decorative panel, the one side of the suction grille and the one side of the decorative panel being secured to each other by a plurality of fall prevention strings each extending between the suction grille and the decorative panel, the decorative panel being provided with two panel claw portions to which respective portions of the plurality of fall prevention strings are to be hooked, the suction grille is provided with two grille claw portions to which respective end portions of the plurality of fall prevention strings are to be hooked, the two panel claw portions and the two grille claw portions being arranged such that a distance W1 between the two panel claw portions is greater than a distance W2 between the two grille claw portions, the two panel claw portions are arranged in a longitudinal direction of the decorative panel, and the two grille claw portions are arranged in a longitudinal direction of the suction grille, and the distance W1 between the two panel claw portions and the distance W2 between the two grille claw portions are determined such that tension forces X by the fall prevention strings which act in the longitudinal direction of the suction grille are equivalent to tension forces Z by the fall prevention strings which act in a vertical direction.

2. The indoor unit of claim 1, wherein the suction grille includes long-side wall portions facing to each other, each of the two grille claw portions includes:

an intermediate wall portion protruding from the long-side side wall portion; and a protrusion portion having a semi-annular shape and ends connected to the intermediate wall portion, and the protrusion portions of the two grille claw portions are formed to protrude from the intermediate wall portions of the two grille claw portions.

3. The indoor unit of claim 1, wherein the decorative panel includes:

a center frame portion which is located at a center of the decorative panel in the width direction as seen in plan view, and extends in the longitudinal direction; and an outer frame portion which is located at an end portion of the decorative panel in the width direction as seen in plan view, and which faces the center frame portion and extends in the longitudinal direction, and each of the panel claw portions includes:

a pillar portion formed to protrude from an inner wall portion forming a surface of the outer frame portion which faces the center frame portion, the pillar portion having ends, one of which is connected to the inner wall portion and another end of which is bifurcated into two end portions; and curved portions curved from the end portions of the pillar portion toward a connection portion between the inner wall portion and the pillar portion, the curved portions forming distal end portions of the panel claw portion.

4. An air-conditioning apparatus provided with the indoor unit of claim 1.

* * * * *